United States Patent [19]

Bertolacini et al.

[11] 4,420,388

[45] Dec. 13, 1983

[54] HYDROTREATING VACUUM GAS OILS WITH CATALYST AND ADDED ORGANIC FLUORINE COMPOUND

[75] Inventors: Ralph J. Bertolacini, Naperville; James F. Mosby, Palos Heights; John G. Schwartz, Naperville, all of Ill.

[73] Assignee: Standard Oil Company (Indiana), Chicago, Ill.

[21] Appl. No.: 301,754

[22] Filed: Sep. 14, 1981

[51] Int. Cl.[3] ..... C10G 47/12

[52] U.S. Cl. ..... 208/112; 208/216 R

[58] Field of Search ..... 208/112, 216 R

[56] References Cited

U.S. PATENT DOCUMENTS

| | | | |
|---|---|---|---|
| 2,119,647 | 6/1938 | Pier et al. | 208/112 |
| 2,964,462 | 12/1960 | Thomas et al. | 208/108 |
| 3,125,511 | 3/1964 | Tupman et al. | 208/264 |
| 3,159,569 | 12/1964 | Hansford | 208/110 |
| 3,305,477 | 2/1967 | Peck et al. | 208/112 |
| 3,673,112 | 6/1972 | Levinson | 208/112 |
| 4,181,601 | 1/1980 | Sze | 208/143 |

*Primary Examiner*—Patrick Garvin
*Assistant Examiner*—O. Chaudhuri
*Attorney, Agent, or Firm*—William H. Magidson; William T. McClain

[57] ABSTRACT

The method of converting at least 20% by weight of a vacuum gas oil fraction boiling above 650° F. into products having a boiling point less than about 650° F., which comprises hydrotreating a vacuum gas oil with a hydrodesulfurization catalyst comprising a Group VIB and Group VIII metal wherein an organic fluorine compound is added to the vacuum gas oil during hydrotreating and the vacuum gas oil is hydrotreated under hydrogen at a temperature of at least 740° F.

7 Claims, No Drawings

HYDROTREATING VACUUM GAS OILS WITH CATALYST AND ADDED ORGANIC FLUORINE COMPOUND

This invention relates to hydrotreating vacuum gas oils containing at least 0.5% by weight sulfur with a hydrodesulfurization catalyst wherein an organo-fluorine compound is added on stream to the vacuum gas oil feed and the vacuum gas oil is hydrotreated under hydrogen at a temperature of at least 740° F.

In the last few years, it has become necessary to process oils containing higher and higher levels of sulfur. At the same time, environmental rules have placed more stringent limitations on the amount of sulfur that can be emitted into the air. In many refineries, low sulfur vacuum gas oils are hydrodesulfurized to a relatively low sulfur content and conveyed to a cracking unit, such as a fluidized catalytic cracker. When a low sulfur vacuum gas oil is employed, a relatively high percentage of the sulfur is removed from the vacuum gas oil before the hydrotreated product is cracked. Even in these cases, an undesirable level of $SO_x$ can be emitted from the cracking units. This has led to numerous schemes and additives for converting the $SO_x$ to $H_2S$ which can be handled readily in sulfur recovery units attached to hydrotreating units and cracking units. As the level of sulfur in the vacuum gas oil increases, there is less complete conversion of sulfur to $H_2S$ in the hydrotreating units and a commensurately higher load of $SO_x$ produced in the cracking units. For example, it is not unusual when processing a vacuum gas oil containing 3% sulfur in conventional hydrotreating units to remove only 90% of the sulfur. However, this is not satisfactory today. Since some refineries lack cracking facilities or have insufficient cracking capacity for processing all the hydrodesulfurized vaccum gas oil produced, substantially complete removal of sulfur from gas oils during hydrodesulfurization is even more important. Accordingly, there is a need for more efficient methods of reducing the level of sulfur in vacuum gas oils.

As indicated above, some refineries do not have adequate cracking facilities for treating all hydrodesulfurized gas oil. Accordingly, the product slate produced by hydrodesulfurization is critical to the economic viability of the refinery. It is important that these refineries have means of converting the hydrodesulfurized gas oils into large volume products boiling below 650° F., such as, gasoline or middle distillates. Unfortunately, hydrodesulfurization produces very little gasoline or middle distillates since there is less than 10% conversion of the 650+° F. fraction. Therefore, there is a need for hydrodesulfurization processes that produce substantially higher levels of gasoline and middle distillates, preferably middle distillates boiling below 650° F. High volumes of middle distillates are desirable since they can be utilized for diesel fuel.

It is well known that hydrodesulfurization catalysts have optimum temperature ranges to accomplish the desired result. For example, the conventional cobalt-molybdenum and nickel-molybdenum hydrodesulfurization catalysts are generally employed at a temperature of around 700° F. If one carries out hydrodesulfurization with these molybdenum catalysts at higher temperatures, such as 740° F., the catalysts deactivate rapidly. Accordingly, it is not possible to obtain greater conversion of the 650+° F. by raising the treating temperature of the vacuum gas oil.

Numerous patents describe the use of halogen promoters for the treatment of petroleum streams. Some of these patents describe the treatment of various hydroprocessing catalysts with halogens such as a chlorine and fluorine. In other cases, organic halogen compounds, preferably carbon tetrachloride, have been added to the hydrocarbon stream being treated. In most cases the patentees desire to avoid the conversion of the hydrocarbon stream into low-boiling gaseous materials.

Sze U.S. Pat. No. 4,181,601 discloses a process of producing light olefins, benzene, toluene and xylenes wherein a halogenated bimetallic catalyst is employed to hydrotreat gas oils without excessive hydrocracking and gas production at a temperature of about 640° F. to 950° F. followed by thermal cracking. The patentee indicates that there are increased yields of light olefins, benzene, toluene and xylene ensuing from the use of the halogenated catalyst in the first step of the two step process. While the patentee indicates that either chlorine or fluorine substituted organic compounds can be employed to halogenate the catalyst on stream, all of the examples in the patent utilize organic chlorine compounds. Further, while the patentee indicates that the hydrogenation can be carried out at 640° F. to 950° F., preferably 650° F. to 750° F., all of the examples employ a temperature in the range of about 690° F. to 700° F. The patentee fails to appreciate the fact that the use of an organic fluorine compound plus a higher temperature in the range of about 740° F. to 800° F. results in advantageous hydrocracking of the fraction of the gas oils boiling at more than 650° F. without the formation of undesirable gaseous products.

Michelson U.S. Pat. No. 4,220,557 discloses the fluoriding of hydrodesulfurization catalysts with fluorosilicates. While the patentee indicates that these catalysts can be advantageously used for the hydrogenation and cracking of organic sulfur and nitrogen compounds in hydrocarbon feedstocks, including light and heavy gas oils, at a temperature of 450° F. to 900° F., preferably 550° F. to 800° F., the patentee's sole example is directed to hydrodesulfurization of a light diesel fuel boiling between 400° F. and 650° F. with the hydrodesulfurization being carried out at 700° F. However, the patentee fails to recognize that it is possible to convert a substantial portion of the 650+° F. fraction of vacuum gas oils to middle distillates by treatment at approximately 740° F. to 780° F. with on stream fluoriding of the catalyst.

The general object of this invention is to provide a process of hydrotreating relatively high sulfur vacuum gas oils under conditions wherein substantially all of the sulfur contained in the vacuum gas oil is converted to $H_2S$ and wherein approximately 20 to 50% by weight or more of the vacuum gas oil fraction boiling above 650° F. is converted into products having a boiling point less than about 650° F. without the formation of excessive quantities of low molecular weight gaseous hydrocarbons, such as ethane, propane, etc. Other objects appear hereinafter.

We have now found that the objects of this invention can be attained by hydrotreating vacuum gas oils containing at least 0.5% sulfur, preferably at least 1% sulfur, with a hydrodesulfurization catalyst wherein an organic fluoride compound is added to the vacuum gas oil feed during hydrotreating and the vacuum gas oil is hydrotreated under hydrogen at a temperature of at least 740° F. Our studies have shown that there is relatively little hydrocracking of the vacuum gas oil unless the vacuum gas oil is heated to at least 740° F. with cobalt-molybdenum catalyst. Further, hydrocracking does not start until such time as substantially all of the sulfur in the feedstock capable of being removed at 740° F. has been removed. When prior art processes are carried out at about 700° F. without on stream fluoriding using a vacuum gas oil containing 3% by weight sulfur (1) only about 90% of the sulfur is removed and (2) there is less than 10% conversion of the fraction boiling at above 650° F. Other things being equal when the process of this invention is employed there is 99% removal of sulfur and over 20% conversion of the fraction boiling at above 650° F. into desirable non-gaseous products.

Although the organo-fluorine compound can be added continuously to the hydrocarbon stream, it is generally preferable to add a sufficient concentration of organo-fluorine compound to the hydrocarbon stream to raise the level of fluorine on the catalyst to about 0.5 to 6% by weight and then operate the hydrocracker for several weeks without replenishment of the organo-fluorine compound. The instant process has the additional advantage that it is possible to operate the unit as a hydrotreater without any substantial hydrocracking by allowing the fluorine to dissipate during use. The unit can be operated as a hydrocracker again by replenishing the organo-fluorine compound from time to time.

Briefly, this invention comprises hydrotreating vacuum gas oils containing at least 0.5% by weight sulfur, preferably at least 1% by weight sulfur, with a hydrodesulfurization catalyst comprising a Group VIB metal and Group VIII metal wherein an organic fluoride compound is added to the vacuum gas oil feed during hydrotreating and the vacuum gas oil is hydrotreated under hydrogen at a temperature of at least 740° F.

As indicated above, vacuum gas oils useful in this invention contain at least 0.5% by weight sulfur, preferably at least 1% by weight sulfur. While substantially any vacuum gas oil can be used in this invention, the process is particularly useful for hydrodesulfurization of vacuum gas oils having a substantial quantity of sulfur. For example, the process of this invention can be utilized to remove approximately 99% by weight of the sulfur contained in a vacuum gas oil having 3% by weight sulfur.

The catalyst useful in this invention is a bimetallic catalyst comprising at least one metal from Group VIB and at least one metal from Group VIII of the periodic table. The Group VIB metal is generally molybdenum and the Group VIII metal is generally nickel and/or cobalt. The active form of the catalyst is the sulfided form and such sulfiding can be effected prior to the use of the catalyst, or in situ, since the gas oil feed contains sulfur. The catalyst can be supported on any of the supports normally used in this art, such as, alumina; alumina-silica; alumina-silica containing zeolites; alumina-magnesia, etc. The various Group VIB and Group VIII metals can be used in the concentrations normally employed in this art.

The organic fluorine compounds include carbon tetrafluoride; difluoroethane, fluorobenzene, etc. As indicated above, the fluorine component apparently reacts with the support to provide hydrocracking activity to the catalyst. Further, the fluorine component acts as a stabilizer for the catalyst in the sense that it permits the catalyst to be utilized at a higher temperature without deactivation of the catalyst. For example, whereas typical molybdenum/Group VIII catalysts deactivate at a temperature of about 740° F. and higher, the fluorided catalysts utilized in this invention function effectively as hydrocracking catalysts at a temperature range of about 740° F. to 800° F. without deactivation. The catalysts can be pretreated with any fluorine containing compound, such as organo-fluorine compounds or inorganic fluorine compounds prior to use. However, the preferred procedure is to treat the catalyst in situ with a fluoro-substituted hydrocarbon in the vacuum gas oil feedstock. Irrespective of the fluoriding method, sufficient fluorine containing compound should be reacted with the catalyst to increase its weight by 0.5 to 6%. Further, it is essential for the purpose of this invention that organo-fluorine compound be supplied to the catalyst from time to time to maintain hydrocracking activity and stabilizing effect on the catalyst. Under these circumstances, the fluorine containing compound is supplied as an organo-compound which decomposes on contact with the catalyst. The orgao-fluorine containing compounds have the advantage that there is less of a tendency for degradation of the reactor walls due to the formation of hydrofluoric acid.

Hydrogenation is effected at a temperature of at least 740° F., e.g. 740°–800° F. Other things being equal, the higher the reaction temperature, the greater the conversion of the 650+° F. fraction of the gas oil into 650−° F. material. For example, at about 740° F., there is at least 20% conversion of the 650+° F. fraction, whereas at about 780° F., there is approximately 50% conversion of the 650+° F. fraction. The maximum temperature is dependent on the metallurgical limits of the reactor. The hydrodesulfurization reaction is carried out under hydrogen using a sufficient concentration of hydrogen to effect efficient hydrotreating and hydrocracking of the vacuum gas oil. In general, hydrogen can be employed in a concentration of 1,000 to 15,000 SCF per barrel. The liquid hourly space velocity can range from about 0.5 to 3.40.

EXAMPLE I

A Kuwait heavy vacuum gas oil having a gravity of 22.8° API, 3.01 percent by weight sulfur, 0.09 percent nitrogen, 4.9 percent by weight fraction boiling between 360° to 650° F. and 95.1 percent by weight fraction boiling at 650+° F. was hydrotreated in an isothermal bench-scale, trickle-bed reactor using once-through hydrogen. The reactor had a nominal inside diameter of 0.546", a thermowell with a nominal outside diameter of 0.125" which passed axially through the catalyst bed. Eurotherm temperature controls were used to maintain an isothermal (±3° F.) reactor bed temperature by means of electrical heaters around the top, middle and bottom sections of the reactor. The 33.5 cc catalyst bed was 9.2" in length and was loaded into the middle heating zone with the oil delivered to the reactor by a Ruska pump together with hydrogen. The 2-phase reactant mixture (oil and hydrogen) passed vertically downward through the catalyst bed comprising a sulfided commercial 1/16" cobalt-molybdenum on alumina extrudate. The products were then passed into a separator with the flow of liquid product being controlled by a level control valve. The conditions of reaction over a 27 day period are set forth below in Table I. The catalyst was fluorided over the period of days 8 to 9 and again at day 21 by adding difluoroethane in liquid naphtha from a second Ruska pump to the gas oil.

Fluoridation at days 8 and 9 was continued until the catalyst had a weight gain of approximately 3 percent by weight fluoride. Fluoridation at day 21 was continued until the fluoride level was approximately 3 percent by weight. Table I also indicates the sulfur content of the treated gas oil and the extent of conversion of the 650+° F. fraction of the vacuum gas oil.

TABLE I

| Days on Oil | Temperature °F. | LHSV Vo/Hr/Vc | Wt. % Sulfur | Wt. % 650 + °F. Conversion | Wt. % Desulfurization |
|---|---|---|---|---|---|
| 1 | 650 | 1.68 | 1.62 | 3.07 | 47.04 |
| 2 | 650 | 1.68 | 1.63 | 2.35 | 46.91 |
| 3 | 650 | 1.68 | 1.61 | 4.28 | 47.31 |
| 4 | 700 | 1.68 | 0.96 | 6.97 | 68.73 |
| 5 | 700 | 1.68 | 0.85 | 6.70 | 72.34 |
| 6 | 700 | 1.68 | 0.87 | 6.58 | 71.66 |
| 7 | 700 | 1.68 | 0.90 | 6.72 | 70.72 |
| 8 | 650 | 1.80 | 1.30 | 4.83 | 57.50 |
| 9 | 650 | 1.80 | 1.48 | 3.97 | 51.67 |
| 10 | 700 | 1.68 | 0.90 | 5.08 | 70.74 |
| 11 | 700 | 1.68 | 0.74 | 5.43 | 75.95 |
| 12 | 700 | 1.68 | 0.80 | 5.60 | 74.01 |
| 13 | 700 | 1.68 | 0.74 | 6.09 | 75.99 |
| 14 | 700 | 1.68 | 0.70 | 5.61 | 77.21 |
| 15 | 739 | 1.68 | 0.33 | 10.03 | 89.36 |
| 16 | 740 | 1.68 | 0.29 | 12.45 | 90.64 |
| 17 | 740 | 1.68 | 0.30 | 13.31 | 90.31 |
| 18 | 741 | 0.45 | 0.02 | 29.24 | 99.37 |
| 19 | 741 | 0.45 | 0.09 | 24.78 | 97.14 |
| 20 | 740 | 0.45 | 0.02 | 26.71 | 99.26 |
| 21 | 650 | 0.45 | 0.28 | 11.51 | 90.91 |
| 22 | 740 | 0.45 | 0.05 | 27.96 | 98.40 |
| 23 | 740 | 0.45 | 0.02 | 30.22 | 99.39 |
| 24 | 740 | 0.45 | 0.02 | 30.85 | 99.37 |
| 25 | 740 | 0.45 | 0.01 | 29.48 | 99.58 |
| 26 | 740 | 0.45 | 0.01 | 31.26 | 99.65 |
| 27 | 740 | 0.45 | 0.01 | 29.84 | 99.61 |

The above Table clearly shows that there is no substantial conversion of 650+° F. material until the catalyst is fluorided and the reaction temperature is raised to about 740° F. Further, the above data clearly shows it is possible to remove in excess of 99% by weight of the sulfur contained in the vacuum gas oil. In days 18 through 27 when the process was operated at about 740° F. using a fluorided catalyst, there was in excess of 20% by weight conversion of the 650+° F. fraction of the vacuum gas oil.

EXAMPLE II

When the process described in Example I was carried out at approximately 760° F. for a ten day period after fluoriding, the average degree of conversion of the 650+° F. fraction of the vacuum gas oil was approximately 35% and desulfurization was at least 99.4%.

EXAMPLE III

When the process described in Example I was repeated at a temperature of about 780° F. for a period of ten days after fluoriding, the average degree of conversion of the 650+° F. fraction of the vacuum gas oil was about 48% and desulfurization was at least 99.5% by weight.

We claim:

1. The method of hydrotreating which comprises converting at least 20 percent by weight of a vacuum gas oil fraction boiling above 650° F. into products having a boiling point less than about 650° F. with a hydrodesulfurization catalyst comprising a Group VIB and Group VIII metal on a support consisting essentially of alumina wherein an organic fluorine compound is added to the vacuum gas oil during hydrotreating and the vacuum gas oil is hydrotreated under hydrogen at a temperature of at least 740° F.

2. The process of claim 1 wherein the Group VIB metal is molybdenum and the Group VIII metal is cobalt or nickel.

3. The process of claim 2 wherein hydrotreating is carried out at a temperature of about 740° F. to 800° F.

4. The process of claim 3 wherein the vacuum gas oil contains at least 0.5 percent by weight sulfur.

5. The method of hydrotreating which comprises converting at least 20 percent by weight of a vacuum gas oil fraction boiling above 650° F. into products having a boiling point less than about 650° F. which comprises hydrotreating a vacuum gas oil having at least a 0.5 percent by weight sulfur with a hydrodesulfurization catalyst comprising cobalt and molybdenum on a support consisting essentially of refractory alumina wherein an organo-fluorine compound is added to the vacuum gas oil and said vacuum gas oil is hydrotreated under hydrogen at a temperature of at least 740° F.

6. The process of claim 5 wherein sufficient organo-fluorine compound is added to provide the catalyst with 0.5 to 6 percent by weight fluoride and the vacuum gas oil is hydrotreated under hydrogen at a temperature of 740° to 800° F.

7. The process of claim 1 wherein said support is alumina.

* * * * *